US005667617A

United States Patent [19]

Fogle

[11] Patent Number: 5,667,617

[45] Date of Patent: Sep. 16, 1997

[54] COMPOSITE WEB AND METHOD OF MAKING AND USING SAME INCLUDING A MEANS FOR SECURING THE TAIL OF THE WEB

[75] Inventor: Ronald L. Fogle, Springboro, Ohio

[73] Assignee: Monarch Marking Systems, Inc., Dayton, Ohio

[21] Appl. No.: 583,252

[22] Filed: Jan. 5, 1996

[51] Int. Cl.[6] ..... B65H 81/00; B65H 19/20

[52] U.S. Cl. ..... 156/247; 156/184; 156/187; 156/289; 156/291; 428/40.1; 428/41.9; 428/906

[58] Field of Search ..... 48/40.1, 41.9, 48/906; 156/184, 187, 247, 289, 290, 291, 344; 242/18 EW, 173

[56] References Cited

U.S. PATENT DOCUMENTS

| | | | |
|---|---|---|---|
| 2,780,352 | 2/1957 | Schroeder | 428/406 X |
| 2,957,637 | 10/1960 | Hosken | 428/906 X |
| 3,134,980 | 5/1964 | Alexander | 428/906 X |
| 3,196,034 | 7/1965 | Pandolfo, III | 428/906 X |
| 3,470,052 | 9/1969 | Herman | 156/184 |
| 3,532,572 | 10/1970 | Herman | 156/184 X |
| 3,532,573 | 10/1970 | Herman | 156/184 X |
| 3,553,055 | 1/1971 | Janik | 156/184 X |
| 3,783,083 | 1/1974 | Jenkins . | |
| 3,960,272 | 6/1976 | Hartbauer et al. | 156/184 X |
| 4,297,403 | 10/1981 | Smith | 428/906 X |

*Primary Examiner*—Jeff H. Aftergut
*Attorney, Agent, or Firm*—Joseph J. Grass

[57] ABSTRACT

There is disclosed a composite web roll of pressure sensitive labels. The composite web comprises a composite label web including a carrier web and labels releasably adhered to the carrier web by pressure sensitive adhesive. By adhesively securing the underside of the carrier web of an end portion of the composite web to adjacent labels along the end portion, when the outer free end portion is unwound, the labels to which the adhesive is adhered are stripped from the carrier web. The disclosure also relates to method of making and using composite webs according to the invention.

16 Claims, 2 Drawing Sheets

COMPOSITE WEB AND METHOD OF MAKING AND USING SAME INCLUDING A MEANS FOR SECURING THE TAIL OF THE WEB

BACKGROUND OF THE INVENTION

1. Field of the Invention

This invention relates to composite webs and to method of making and using same.

2. Brief Description of the Prior Art

In a known type of labeler depicted in U.S. Pat. No. 3,783,083 granted to Willlam A. Jenkins it is highly desirable to strip a predetermined number of labels from the carrier web before threading the carrier web through the labeler. This can be accomplished by manually picking some of the labels from an end portion of the carrier web. Alternatively the composite web can be partially threaded through the labeler just past the delaminator and then the portion of the composite web which projects out of the labeler can be manually grasped and the carrier web can be manually pulled about the delaminator to strip the desired number of labels from the carrier web.

It is known in the prior art to wrap a pressure tape around the outer wrap of a label roll. The adhesive on the tape is in contact with and adheres to the labels on the outer wrap. Removal of the tape can result in removal of some or all of the labels on the outer wrap.

It is also known in the prior art to apply adhesive to the underside of the carrier web of the outer wrap of a label roll to adhere the outer wrap to the labels on the inner wrap. This keeps the label roll intact. The adhesive was only applied adjacent the outer free end portion of the carrier web and extended in length up to about three labels or about three inches. This resulted in up to about three labels or three inches of the inner wrap being delaminated or removed when the outer wrap was manually unwound by the user.

SUMMARY OF THE INVENTION

In accordance with the invention, there is provided an improved composite label web roll and methods of making and using same, by which labels are automatically stripped from the carrier web for easy threading of the labeler.

In accordance with a specific embodiment of the invention, there is provided a composite label web including a carrier web having a top side and an underside and a series of labels releasably adhered by pressure sensitive adhesive to the top side of the carrier web. The composite label web is wound into a roll which has an outer free end portion. The outer free end portion includes a first zone and a second zone. The first zone is between the outer free terminal end of the composite web and the second zone. Adhesive adheres the underside of the carrier web in the first zone to labels in the second zone. Unwinding of the end portion causes labels to be stripped from the second zone. The carrier web can then be torn between the first and second zones and thereupon the remainder of the outer free end portion which comprises the second zone can be threaded into the labeler.

The invention also relates to method of making a composite web which results in a roll from which labels can be automatically stripped as the outer wrap is being unraveled, and to method of using such a web.

DETAILED DESCRIPTION OF THE PREFERRED EMBODIMENT

Figure 1:
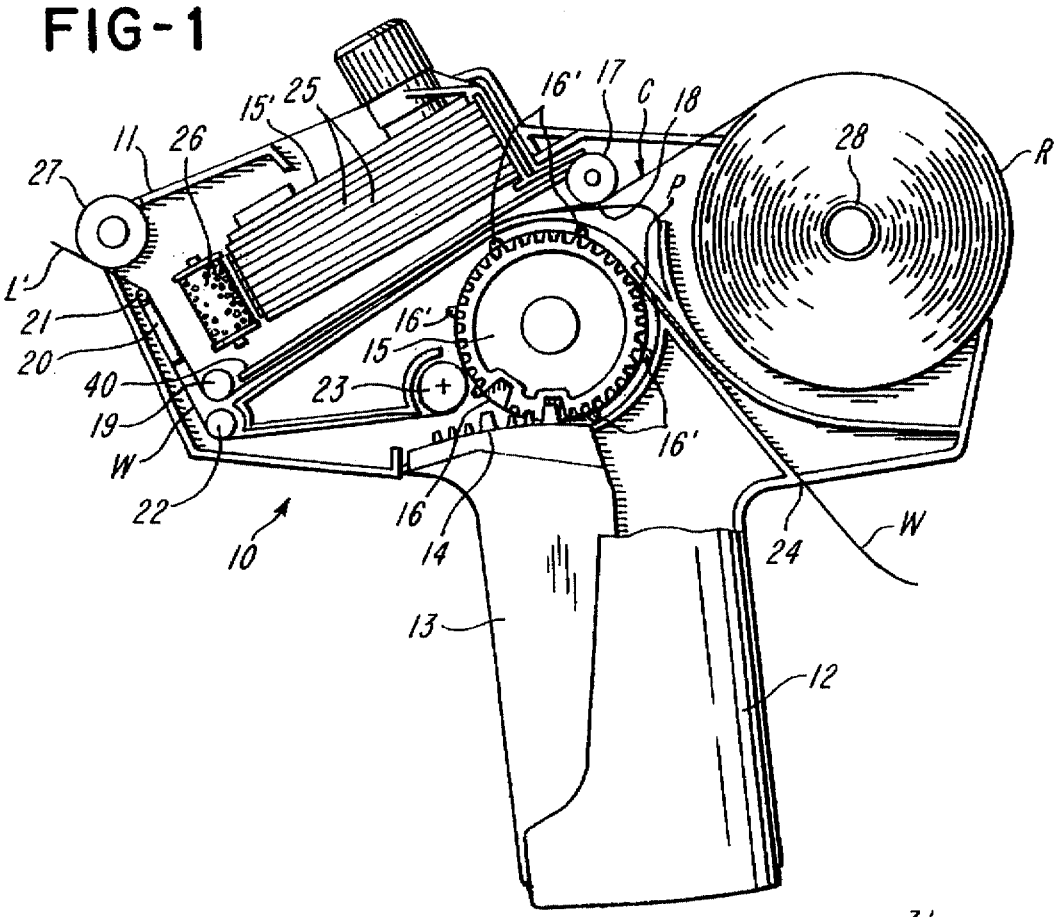
FIG. 1 is a diagrammatic partly broken away side elevational view of a labeler having a roll of a composite web of labels.
Figure 3:
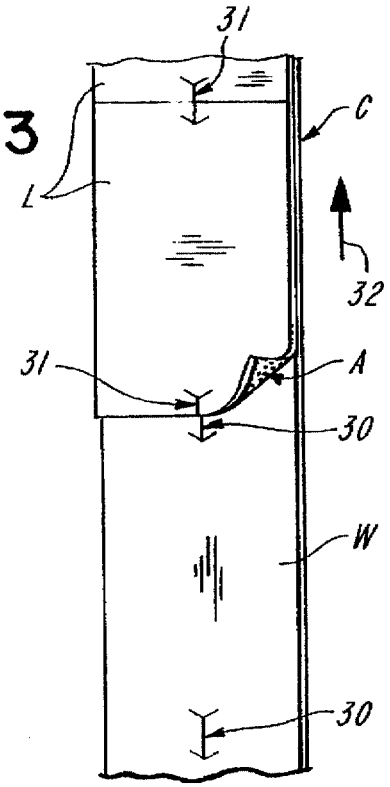
FIG. 3 is a perspective view of a composite web of labels which constitutes the roll in FIG. 2.
Figure 4:
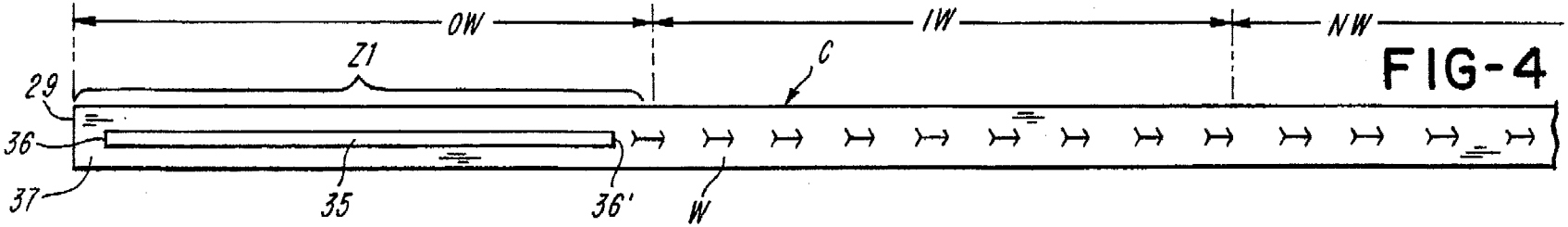
FIG. 4 is a bottom plan view showing the end portion of the composite web in accordance with the invention before being wound onto the roll.
Figure 5:
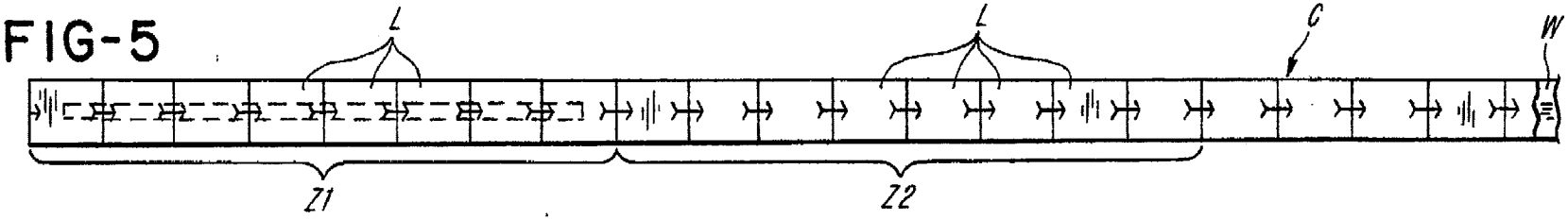
FIG. 5 is a top plan view of the composite web shown in FIG. 4.
Figure 6:
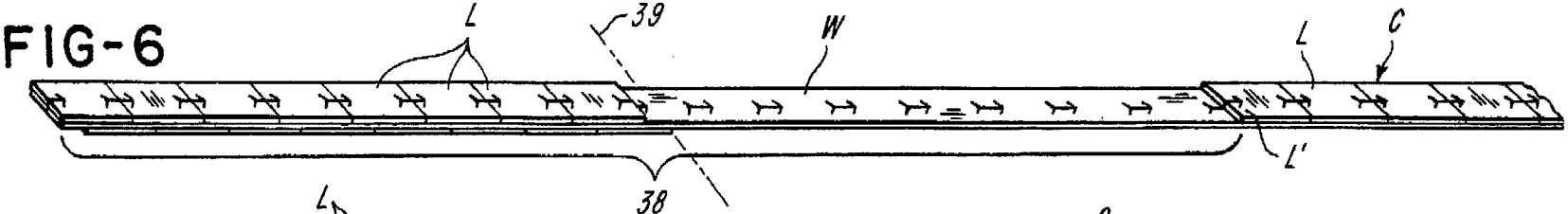
FIG. 6 is a perspective view showing the free end portion of the label web, illustrating labels stripped from the carrier web.
Figure 7:
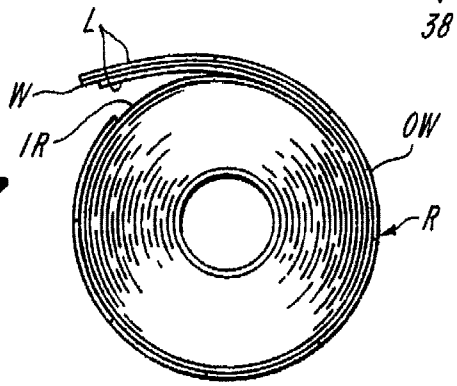
FIG. 7 is a side elevational view showing labels stripped from the inner wrap.

Referring to FIG. 1, there is shown a hand held labeler generally indicated at 10 having a housing 11 and a handle 12. An actuating lever 13 disposed at the handle 12 carries a gear sector 14 which drives a gear 15 which in turn operates the print head 15' and thereafter the feed wheel 16 in sequence. A roll R of a composite label web C is mounted on the housing 11. The composite web C comprises a carrier web W to which labels n are releasably adhered by pressure sensitive adhesive A (FIG. 3). The composite label web C is threaded between a brake roll 17 and a support surface 18 and from there to and partially about a guide roll 19. From there the web C passes over a platen 20 which is aligned with the print head 15'. From there the carrier web W makes a sharp angle about a delaminator 21 at which the leading label L' is stripped or delaminated from the carrier web W. From there the carrier web W passes partially about a guide roll 22 to between the feed wheel 16 and a cooperating idler wheel 23. The carrier web W passes partially around the feed wheel 16 and loses contact with the feed wheel 16 at point P. From there the web W exits the housing 11 at 24.

The print head 15' has printing bands 25 which are inked by an ink roller 26 when the lever 13 is operated. As shown, the leading label L' is positioned in underlying relation to an applicator roll 27 following the printing portion of the cycle of operation of the labeler 10 and from there the leading label L' can be applied to merchandise using the applicator roll 27.

Figure 2:
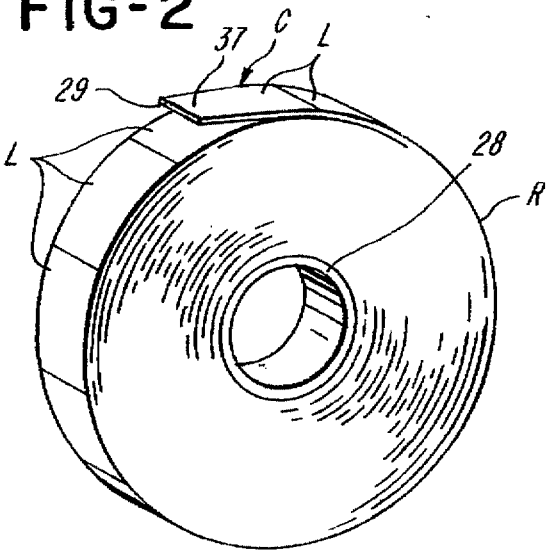
FIG. 2 is a perspective view of a composite web roll in accordance with the invention.

The roll R is also shown in FIG. 2 to have a core 28. The composite web C have an outer free terminal end 29.

FIG. 3 shows the composite web C with a continuous coating of the adhesive A on the underside of the labels L. There are feed slits or feed cuts 30 in the carrier web W at equally spaced apart intervals along the longitudinal extent of the carrier web W. The feed slits 30 are engaged by teeth 16' on the feed wheel 16. There are security slits or cuts 31 in the labels L aligned with the feed slits 30. The slits 31 make the labels L susceptible to tearing when their removal from merchandise is attempted. As shown, the composite web C is feed in the direction of the arrow 32.

Figure 8:
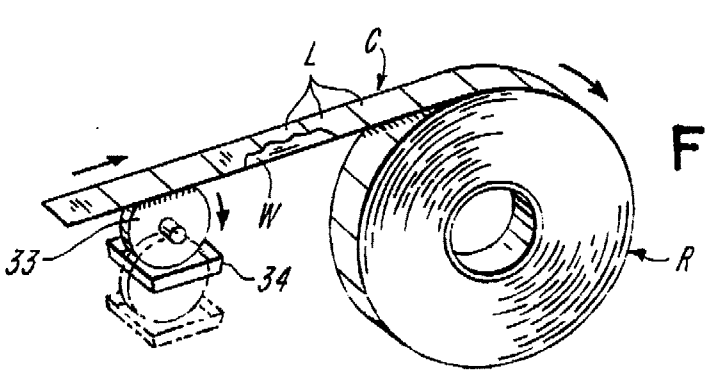
FIG. 8 is a perspective view showing adhesive being applied to the carrier web.

According to the invention, adhesive 35 is applied to a first zone Z1 of the underside of the carrier web W. FIG. 8 shows an adhesive coating wheel 33 rotatable in a fountain 34 and is in contact with the carrier web W. When the roll R has been almost completely wound up, the coating wheel 33 and fountain 34 are moved into cooperation relative to the carrier web W to apply adhesive 35 to the underside of the carrier web W. The adhesive 35 adheres to the labels L on an adjacent zone Z2. It should be noted that when the composite web C has been wound into roll form as shown in FIG. 2, the adhesive 35 holds the outer wrap OW in place. There is no need for tape to be applied to the outside of outer wrap OW across the terminal free end 29.

The minimum number of labels L required to be stripped from the composite web C is equal to the number of labels which are on a length carrier web W in the path from the delaminator 21, partially about the roll 22, partially about the feed wheel 16 to point P. Thus, the minimum length of the stripe of adhesive 35 in the particular illustrated embodiment is enough to come into contact with the labels required to be removed in order to obtain the full benefits of the invention.

It should be noted that the one end 36 of the adhesive 35 terminates short of the outer free terminal end 29 of the composite web C. This provides a manually graspable tab or handle 37 for the user to grasp and unwind the outer end portion 38 of the composite web C from the roll R.

Outer end portion 38 of the composite web C includes zones Z1 and Z2. When the outer end portion 38 is unwound, the labels n in Zone Z2 are stripped from the carrier web W. The user then tears the carrier web W generally along a line indicated at 39, which is about where zones Z1 and Z2 meet. The distance between line 39 and a label L' should preferably be equal to or more preferably slightly greater than the distance along the path of the carrier web W from the delaminator 21 and the point P. With the composite web roll R prepared as indicated above, the user is now free to load the labeler 10. The carrier web W at zone Z2 is first inserted between the roll 17 and the support surface 18 while the actuator lever 13 is held slightly depressed to release the brake roll 17. The carrier web W is then pushed along a guideway 40 to beyond the guide roll 19. From there the carrier web W is pushed over the platen 20 and the delaminator 21. The carrier web W is passed around the guide roll 22 and between the feed wheel 16 and the idler roll 23. Operation of the actuator lever 13 advances the web W partially about the feed wheel 16 to the point P. Then the outer free end 29 of the web W is at or slightly beyond the point P, the label L' is at the platen 20 beneath the print head 15'. The label L' is now ready to be printed and dispensed into underlying relationship to the applicator roll 27.

It is apparent that the number of labels L on the outer wrap OW of the roll R varies depending on the length of the labels L and the diameter of the roll R. It is therefore possible that the distance between the delaminator 21 and the point P is equal to, less than dr greater than the length of the outer wrap OW. While the adhesive 35 is applied to the underside of the outer wrap OW, end 36' of the adhesive 35 can extend short of, beyond, or to the end of the outer wrap OW. However, it is preferred that the adhesive 35 start at the outer wrap OW even though it may extend to the inner wrap IW. In the event the adhesive 35 extends beyond the outer wrap OW into the inner wrap IW, it is apparent that labels L will also be removed from the next wrap NW which is adjacent the inner wrap IW.

While the adhesive 35 is indicated to take the form of a continuous stripe, it can take the form of a selected pattern.

It is preferred that the adhesive 35 be of a non-tacky adhesive, however, other types of adhesive such as pressure sensitive adhesive, can be used.

Other embodiments and modifications of this invention will suggest themselves to those skilled in the art and all such of these as some within the spirit of this invention are included within its scope as best defined by the appended claims.

We claim:

1. A composite web, comprising: a composite label web including a carrier web having a top side and an underside and a series of labels releasably adhered by pressure sensitive adhesive to the top side of the carrier web, the composite label web being wound into a roll having an outer free end portion including an outer wrap and an inner wrap adjacent the outer wrap, and adhesive adhering the underside of the carrier web of the entire outer wrap to all the labels on the adjacent wrap so that removal of the outer wrap causes all of the labels of the inner wrap to be stripped from the inner wrap.

2. A composite web as defined in claim 1, wherein the adhesive which adheres the outer wrap to the labels of the inner wrap is a non-tacky adhesive.

3. A composite web as defined in claim 1, wherein the outer free end portion terminates at an outer free terminal end, and wherein the adhesive which adheres the outer wrap to the labels of the inner wrap is spaced from the outer free terminal end to provide a manually graspable tab.

4. A composite web as defined in claim 1, wherein the adhesive which adheres the outer wrap to the labels is a continuous stripe.

5. A composite web, comprising: a composite label web including a carrier web having a top side and an underside and a series of labels releasably adhered by pressure sensitive adhesive to the top side of the carrier web, the composite label web having an outer wrap and being wound into a roll having an outer free end portion, the outer free end portion having a first zone and a second zone, the outer free end portion terminating at an outer free terminal end, the first zone being between the outer free end and the second zone, wherein the first zone is at least as long as the outer wrap, and adhesive adhering to the underside of the carrier web of the first zone and the labels of the second zone so that removal of the composite label web from the roll causes all the labels to be stripped from the second zone.

6. A composite web as defined in claim 5, wherein the length of the second zone along the composite label web corresponds to a selected number of labels to be removed.

7. A composite web as defined in claim 5, wherein the adhesive which adheres the underside of the carrier web of the first zone and the labels of the second zone is a non-tacky adhesive.

8. A composite web as defined in claim 5, wherein the outer free end portion terminates at an outer free terminal end and wherein the adhesive which adheres the underside of the carrier web of the first zone and the labels of the second zone is spaced from the terminal end to provide a manually graspable tab.

9. A composite web as defined in claim 8, wherein the length of the second zone along the composite label web corresponds to a selected number of labels to be removed.

10. Method of making a composite web, comprising the steps of: providing a composite label web having an outer wrap and including a carrier web having a top side and an underside and a series of labels releasably adhered by pressure sensitive adhesive to the top side of the carrier web, and the composite label web including an end portion having a first zone and a second zone, wherein the first zone is at least as long as the outer wrap, the end portion terminating at a free end, the first zone being between the free end and the second zone, applying adhesive to one of the zones, and winding the first zone of the composite label web onto the second zone of the composite label web so that all the labels in the second zone are adhered to the carrier web in the first zone.

11. Method as defined in claim 10, wherein the applying step includes applying the adhesive at the first zone.

12. Method of making a composite web, comprising the steps of: providing a composite label web including an outer wrap and including a carrier web having a top side and an underside and a series of labels releasably adhered by pressure sensitive adhesive to the top side of the carrier web, winding the composite label web into a roll except for a free end portion, applying adhesive to the underside of the carrier web at the entire outer wrap at the free end portion, and completing the winding of the free end portion onto the roll to cause adhesion of the free end portion to underlying labels on the carrier web.

13. Method of using a composite web, comprising the steps of: providing a composite web including a carrier web having a top side and an underside and a series of labels releasably adhered by pressure sensitive adhesive to the top side of the carrier web, the composite label web including an outer wrap and being wound into a roll having an outer free end portion, the outer free end portion including an outer wrap and an inner wrap adjacent the outer wrap, and adhesive adhering the underside of the carrier web of the entire outer wrap to labels on the adjacent wrap, and removing the outer wrap from the roll to strip all the labels on the inner wrap from the carrier web of the inner wrap.

14. Method as defined in claim 13, further including the step of separating the outer wrap from the inner wrap.

15. Method of using a composite web, comprising the steps of: providing a composite web including a composite label web including a carrier web having a top side and an underside and a series of labels releasably adhered by pressure sensitive adhesive to the top side of the carrier web, the composite label web having an outer wrap and being wound into a roll having an outer free end portion, the outer free end portion having a first zone and a second zone, wherein the first zone is at least as long as the outer wrap, the outer free end portion terminating at an outer free end, the first zone being between the outer free end and the second zone, and adhesive adhering to the underside of the carrier web of the first zone and the labels of the second zone, and unwinding the first zone of the free end portion from the roll to strip labels in the second zone of the free end portion.

16. Method as defined in claim 15, further including the step of separating the first zone from the second zone.

* * * * *

UNITED STATES PATENT AND TRADEMARK OFFICE

CERTIFICATE OF CORRECTION

PATENT NO. : 5,667,617

DATED : September 16, 1997

INVENTOR(S) : Ronald L. Fogle

It is certified that error appears in the above-indentified patent and that said Letters Patent is hereby corrected as shown below:

Col. 2, line 28 "n" should be --L--.

Col. 3, line 23 "n" should be --L--.

Col. 3, line 51 "dr" should be --or--.

Signed and Sealed this

Twenty-third Day of December, 1997

Bruce Lehman

*Attest:*

BRUCE LEHMAN

*Attesting Officer*

*Commissioner of Patents and Trademarks*